United States Patent [19]

Bartlett

[11] Patent Number: 4,555,907

[45] Date of Patent: Dec. 3, 1985

[54] CRYOPUMP WITH IMPROVED SECOND STAGE ARRAY

[75] Inventor: Allen J. Bartlett, Milford, Mass.

[73] Assignee: Helix Technology Corporation, Waltham, Mass.

[21] Appl. No.: 611,689

[22] Filed: May 18, 1984

[51] Int. Cl.[4] ..... B01D 8/00

[52] U.S. Cl. ..... 62/55.5; 62/268; 55/269; 417/901

[58] Field of Search ..... 62/55.5, 100, 268; 55/269; 417/901

[56] References Cited

U.S. PATENT DOCUMENTS

| | | | |
|---|---|---|---|
| 3,433,297 | 3/1969 | Kohler | 62/55.5 |
| 4,121,430 | 10/1978 | Bachler et al. | 62/55.5 |
| 4,150,549 | 4/1979 | Lonesworth | 62/55.5 |
| 4,295,338 | 10/1981 | Welch | 62/55.5 |
| 4,336,690 | 6/1982 | Welch | 62/55.5 |
| 4,466,252 | 8/1984 | Hood | 62/55.5 |

*Primary Examiner*—Ronald C. Capossela

*Attorney, Agent, or Firm*—Hamilton, Brook, Smith & Reynolds

[57] ABSTRACT

A second stage cryopanel array suitable for both concentric refrigerators and side entry cryopumps is formed of two groups of semi-circular baffles mounted to respective L-shaped brackets. The array sections can be independently positioned about a second stage of a refrigerator.

16 Claims, 11 Drawing Figures

CRYOPUMP WITH IMPROVED SECOND STAGE ARRAY

DESCRIPTION

1. Technical Field

This invention relates to cryopumps and has particular application to cryopumps cooled by two stage closed cycle coolers.

2. Background

Cryopumps currently available, whether cooled by open or closed cryogenic cycles, generally follow the same design concept. A low temperature second stage array, usually operating in the range of 4° to 25° K., is the primary pumping surface. This surface is surrounded by a high temperature cylinder, usually operated in the temperature range of 70° to 130° K., which provides radiation shielding to the lower temperature array. The radiation shield generally comprises a housing which is closed except at a frontal array positioned between the primary pumping surface and the chamber to be evacuated. This higher temperature, first stage, frontal array serves as a pumping site for higher boiling point gases such as water vapor.

In operation, high boiling point gases such as water vapor are condensed on the frontal array. Lower boiling point gases pass through that array and into the volume within the radiation shield and condense on the second stage array. A surface coated with an adsorbent such as charcoal or a molecular sieve operating at or below the temperature of the second stage array may also be provided in this volume to remove the very low boiling point gases. With the gases thus condensed or adsorbed onto the pumping surfaces, only a vacuum remains in the work chamber.

In systems cooled by closed cycle coolers, the cooler is typically a two stage refrigerator having a cold finger which extends through the radiation shield. The cold end of the second, coldest stage of the refrigerator is at the tip of the cold finger. The primary pumping surface, or cryopanel, is connected to a heat sink at the coldest end of the second stage of the cold finger. This cryopanel may be a simple metal plate, a cup or a cylindrical array of metal baffles arranged around and connected to the second stage heat sink. This second stage cryopanel may also support low temperature adsorbent.

The radiation shield is connected to a heat sink, or heat station at the coldest end of the first stage of the refrigerator. The shield surrounds the first stage cryopanel in such a way as to protect it from radiant heat. The frontal array which closes the radiation shield is cooled by the first stage heat sink through the shield or, as disclosed in U.S. Pat. No. 4,356,701, through thermal struts.

In most conventional cryopumps, the refrigerator cold finger extends through the base of a cup-like radiation shield and is concentric with the shield. In other systems, the cold finger extends through the side of the radiation shield. Such a configuration at times better fits the space available for placement of the cryopump. Although complex baffle arrays which provide an extensive pumping surface area are often used for the second stage array of the concentric cryopumps, side entry cryopumps are generally confined to simpler inverted-cup second stage cryopanels.

DISCLOSURE OF THE INVENTION

A cryopump comprises a refrigerator having first and second stages. A second stage cryopanel is in thermal contact with the heat sink on the second stage to condense low condensing temperature gases. A first stage cryopanel is in thermal contact with a heat sink on the first stage and is held at a temperature higher than the second stage to condense higher condensing temperature gases. A radiation shield surrounds the second stage cryopanel. In accordance with principles of the present invention, the second stage cryopanel comprises axially extending, thermally conducting brackets mounted to and in close thermal contact with the refrigerator heat sink. A respective group of baffles spaced along a cryopanel axis is fixed to each bracket.

Preferably, the baffles are semi-circular discs with frustoconical rims. Two groups of such baffles are joined to the brackets on opposite sides of the second stage heat sink and together form a cylindrical array. The brackets are flat, generally L-shaped bars.

The invention has particular utility to side entry cryopumps since it allows relatively complex second stage arrays to be positioned around the side entry cold finger; two array sections can be aligned with the heat sink independently. Using L-shaped brackets, the majority of baffles used in the array are the same for both concentric refrigerator cryopumps and side entry cryopumps.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed on illustrating the principles of the drawings.

PREFERRED EMBODIMENTS OF THE INVENTION

Figure 1:
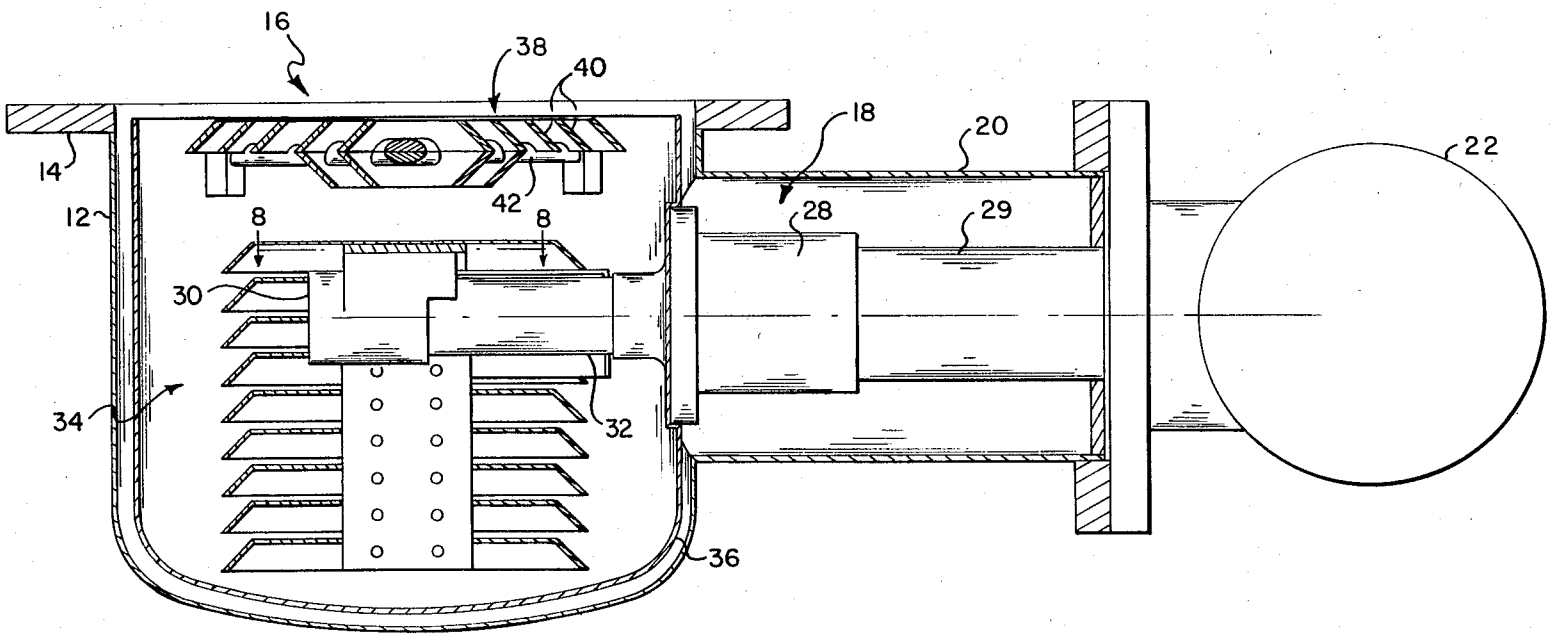
FIG. 1 is a longitudinal cross sectional view of one embodiment of the present invention.
Figure 2:
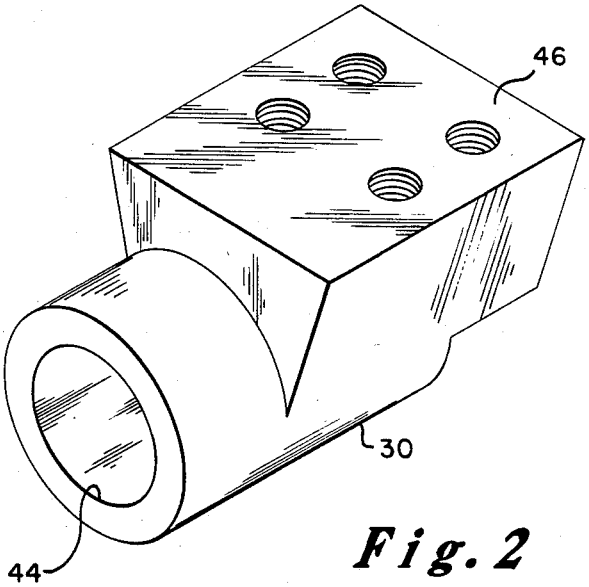
FIG. 2 is a perspective view of the second stage heat sink in the cryopump of FIG. 1.

The cryopump of FIG. 1 comprises a vacuum vessel 12 which may be mounted to the wall of a work chamber along a flange 14. The front opening 16 in the vessel 12 communicates with the circular opening in a work chamber. A two stage cold finger 18 of a refrigerator protrudes into the vessel 12 through a cylindrical portion 20 of the vessel 12. In this case, the refrigerator is a Gifford-MacMahon refrigerator such as disclosed in U.S. Pat. No. 3,218,815 to Chellis et al., but others may be used. A two stage displacer in the cold finger 18 is driven by a motor 22. With each cycle, helium gas introduced into the cold finger under pressure is expanded and thus cooled and then exhausted through line 26. A first stage heat sink, or heat station, 28 is mounted at the cold end of the first stage 29 of the refrigerator. Similarly, a heat sink 30 is mounted to the cold end of the second stage 32.

A primary pumping surface is an array of baffles 34 mounted to the second stage heat station 30. This array is preferably held at a temperature below 20° K. in order to condense low condensing temperature gases. A cup-shaped radiation shield 36 is mounted to the first stage heat station 28. The second stage 32 of the cold finger extends through an opening in the radiation shield. This shield surrounds the second stage array 34 to the rear and sides of the array to minimize heating of the array by radiation. Preferably, the temperature of this radiation shield is less than about 120° K.

A frontal cryopanel array 38 serves as both the radiation shield for the primary cryopanel 34 and as a cryopumping surface for higher boiling temperature gases such as water vapor. This array comprises louvers 40 joined by radial support rods 42. The supports rods 42 are mounted to the radiation shield 36. The shield both supports the frontal array and serves as the thermal path from the heat sink 28 to that array.

The second stage cryopanel array 34 is best described with reference to FIGS. 1–8. The heat station 30 is shown in perspective view in FIG. 2. A bore 44 extending through the heat station is slipped over the end of the cold finger 32 and is retained on the cold finger by a low melting point solder. A flat surface 46 is provided on top of the heat station for mounting of the second stage array as will be described below.

Figure 3:
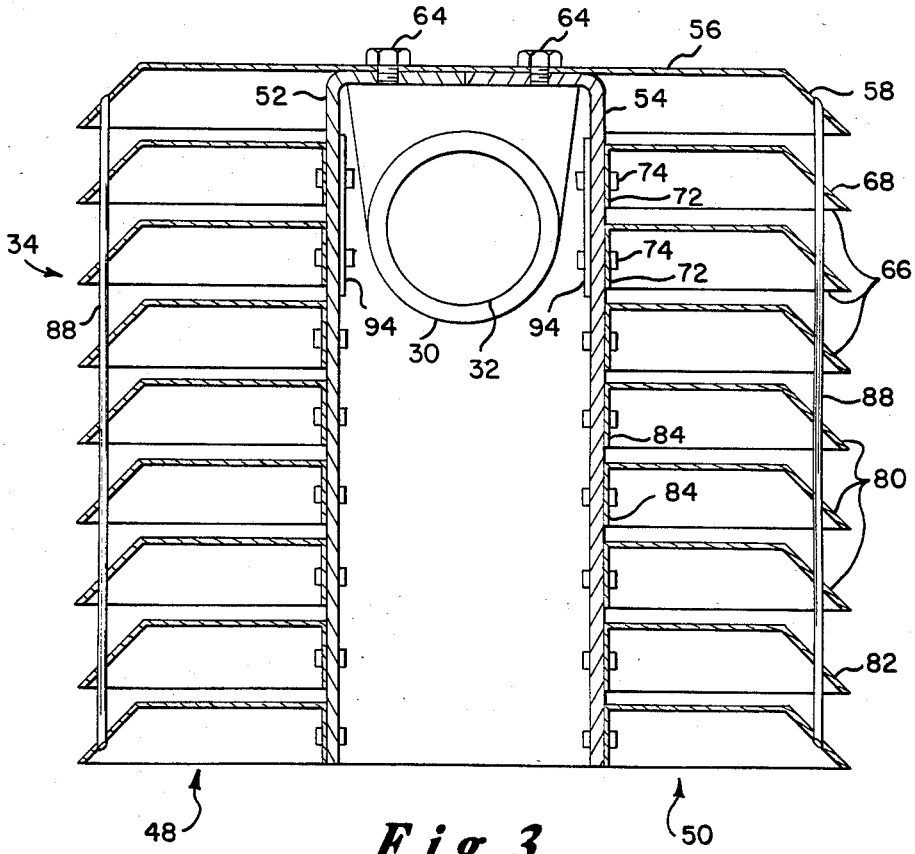
FIG. 3 is a longitudinal sectional view of the second stage array taken along a plane perpendicular to the view of FIG. 1.
Figure 4:
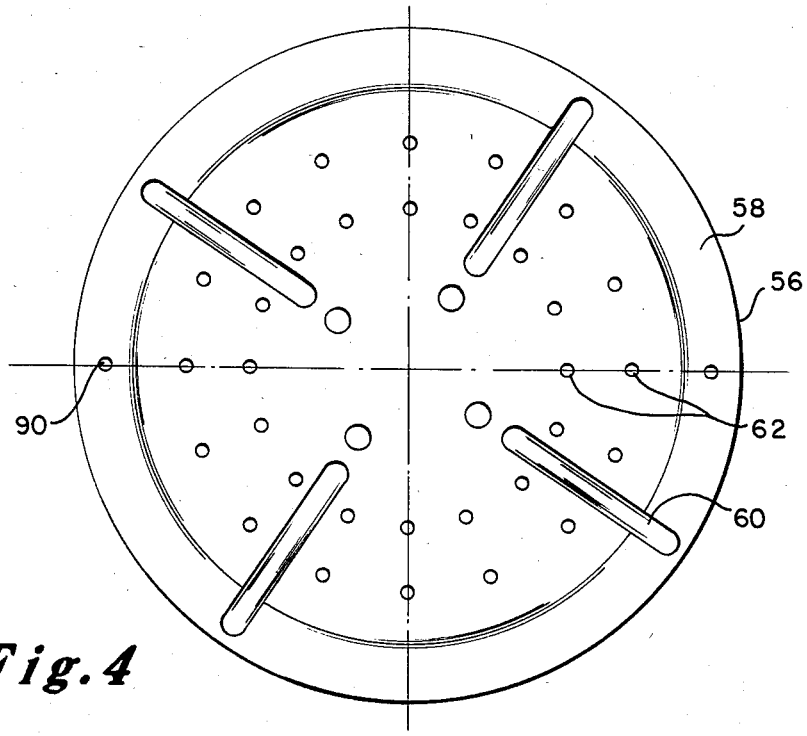
FIG. 4 is a plan view of the top baffle in the system of FIG. 1.

As best shown in FIG. 3, the array is formed of two separate groups of semi-circular baffles 48 and 50 mounted to respective brackets 52 and 54 which are in turn mounted to the flat surface 46 of the heat station 30. Each bracket is a flat L-shaped bar. They extend transverse to the cold finger 32 on opposite sides of the heat station 30. The array 34 includes three different types of baffles shown in FIGS. 4, 5 and 6. A top baffle 56 shown in FIG. 4 is a full circular disc having a frustoconical rim 58. Ribs 60 are formed in the disc for rigidity. Holes 62 are formed in the disc to facilitate adhesion of epoxy to the bottom surface of the disc for holding adsorbent on that surface. The baffle 56 bridges the two brackets 52 and 54 and is joined to the heat station 30 by the same connecting bolts 64.

Figure 5:
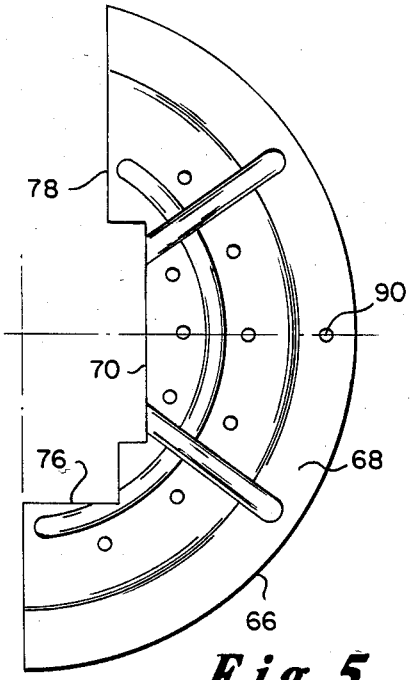
FIG. 5 is a plan view of a center baffle positioned adjacent to the cold finger in the system of FIG. 1.

Three semi-circular baffles 66 shown in FIG. 5 are positioned below the top baffle 56. These baffles also have frustoconical rims 68 and structural ribs and holes for the epoxy. Tabs 72 (FIG. 3) are bent downward from the body of the baffles at a flat, inset region 70. The brackets, such as bracket 54, fit into the regions 70, and the tabs are riveted to the brackets by rivets 74. Additionally, the baffles 66 are cut away at 76 and 78 to accomodate the heat station 30 and the cold finger 32.

Figure 6:
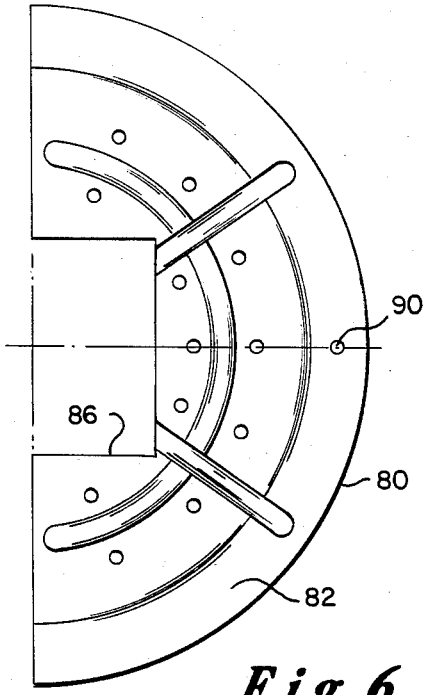
FIG. 6 is a plan view of the lower baffles in the system of FIG. 1.

The remaining baffles are the baffles 80 shown in FIG. 6. These baffles also have the frustoconical rims 82 and structural ribs and holes for epoxy. They have tabs 84 which span the center inset region 86. These tabs are riveted to the brackets 52 and 54.

Charcoal adsorbent is epoxied to the top, flat surfaces of the baffles 66 and 80. If a greater amount of adsorbent is required, adsorbent can also be expoxied to the lower surfaces of both the flat regions and the frustoconical rims. The frustoconical rims intercept and condense condensable gases. This prevents the adsorbent from becoming saturated prematurely. The many baffles provide large surface areas for both condensing and adsorbing gases. The brackets 52 and 54 provide high conductance thermal paths from the baffles to the heat station 30. Preferably, the baffles, brackets and heat station are formed of nickel-plated copper.

In assembly, two groups of semi-circular baffles 66 and 80 are mounted to respective brackets 52 and 54 by rivets to form two independent sections of the final array. The two groups of baffles are then moved into the region within the radiation shield 36 on either side of the cold finger 32, and the brackets are positioned on the heat sink 30 so that flat edges of the baffles of the two array sections butt against each other and form a closed cylindrical array even below the cold finger 32. Once the two sections are positioned with the upper legs of the brackets 52 and 54 positioned on the heat station 30, the upper baffle 56 is placed over the brackets 52 and 54 and the three are bolted to the heat station 30. To improve the rigidity of the array, pins 88 are passed through holes 90 in the baffles and epoxied to the baffles. It can be seen, then, that the closed array can be readily positioned about the side entry cold finger by constructing the array as two array sections which are independently moved into place from either side of the cold finger 32.

Figure 7:
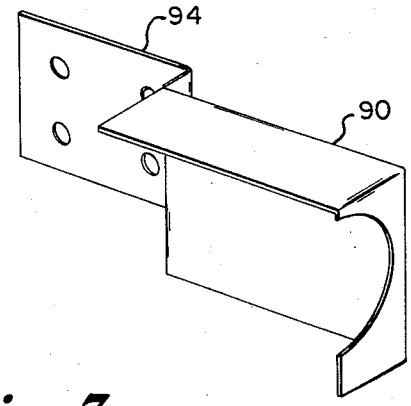
FIG. 7 is a perspective view of a cold finger shield used in the system of FIG. 1.
Figure 8:
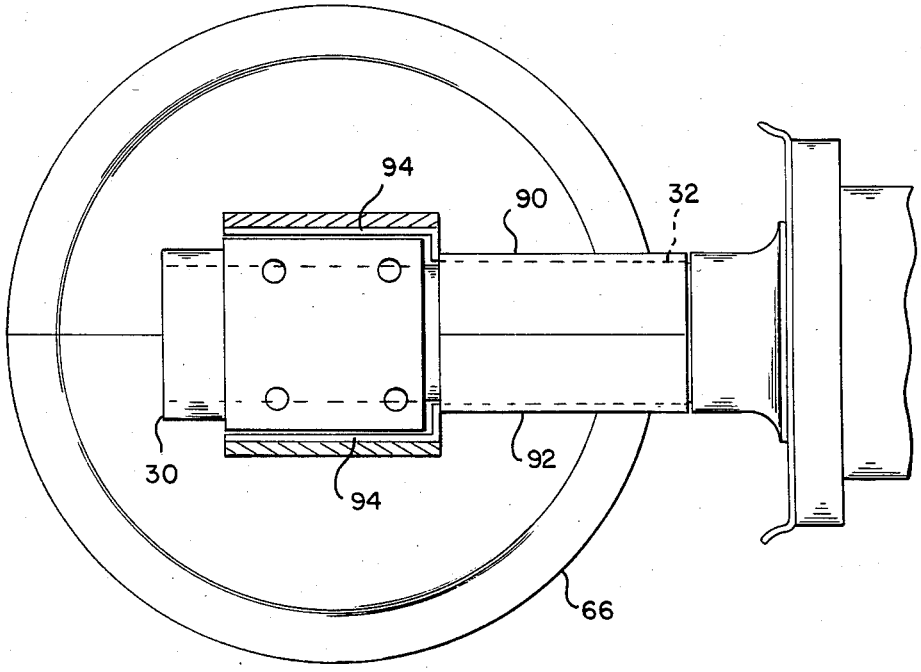
FIG. 8 is a cross sectional view of the second stage array of FIG. 1 taken along lines 8—8.

There is a temperature gradient along the cold finger 32 from a temperature of less than 20° K. at the heat station 30 to a temperature approaching 120° K. at the heat station 28. The temperature gradient is not static but varies with reciprocation of a displacer within the cold finger. To minimize evaporation and subsequent recondensation of gases on the cold finger with fluctuations in temperature along the cold finger, it is best to shield the second stage of the cold finger with a shield cooled by the heat station 30. To that end, a box which is cooled by the heat station 30 is formed about the cold finger 32. As shown in FIGS. 7 and 8, the box is formed of two sections 90 and 92, one of which is shown in perspective in FIG. 7. Arms 94 extend from the box sections and are riveted to the inner surfaces of the brackets 52 and 54 along with baffles 66. The lower side of the box sections 90 are left open, and the uppermost baffle 80 serves to close a substantial portion of the lower side of the box sections.

Figure 9:
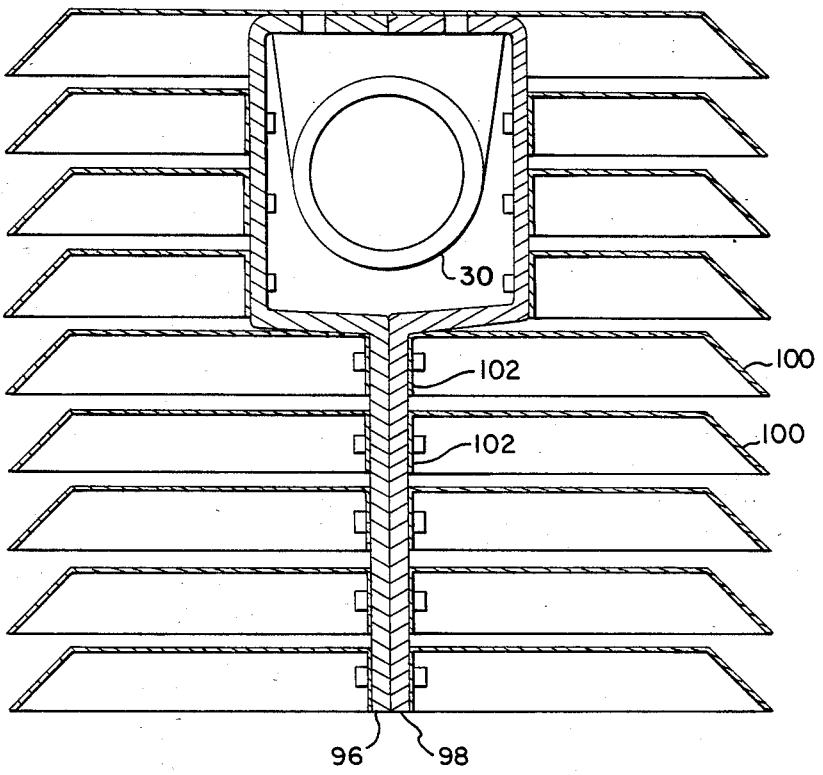
FIG. 9 is an alternative arrangement of the second stage array for use in the system of FIG. 1.

An alternative arrangement of the second stage array is shown in FIG. 9. In the arrangement of FIG. 1, an open region is left within the array between the two brackets 52 and 54. In the embodiment of FIG. 9, the brackets 96 and 98 are shaped to extend close to each other below the heat station 30. The baffles 80 are then replaced with baffles 100 which have only very short regions in which the brackets 96 and 98 are positioned adjacent to tabs 102. In the embodiment of FIG. 9, by extending the baffles 100 into the region below the heat station 30, the surface area available for adsorbent and for condensation of gases is increased.

Figure 10:
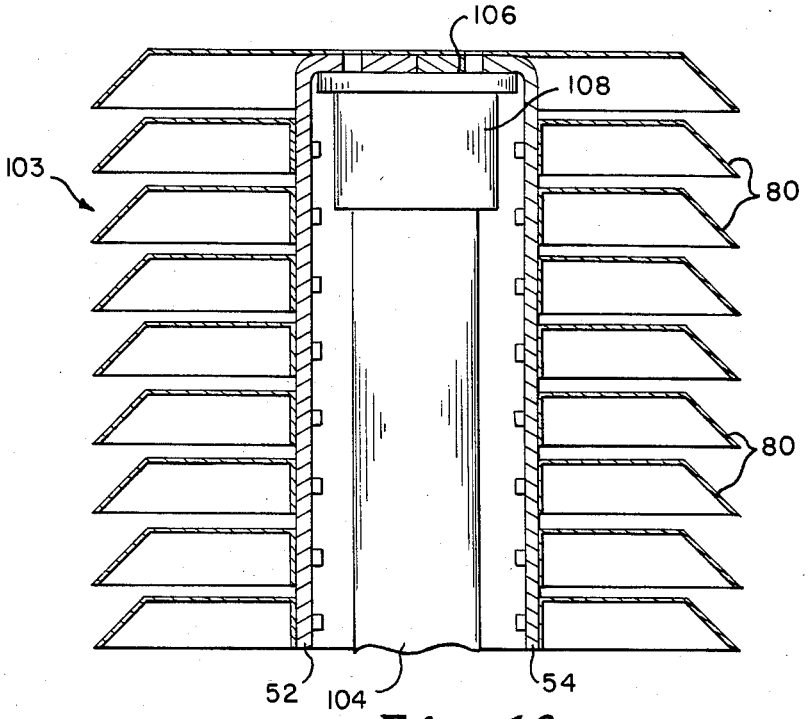
FIG. 10 is a longitudinal sectional view of the second stage array mounted concentric with the refrigerator cold finger.

FIG. 10 illustrates an array 103, similar to that of FIG. 3, positioned concentric with a cold finger 104. The cold finger 104 may for example extend through the base of a radiation shield in a conventional concentric cryopump. With this arrangement, the flat surface 106 for mounting the array is on the end of a heat station 108.

It should be noted that the array 103 of FIG. 10 is identical to the array 34 of FIG. 3 except that the baffles 66 are replaced with baffles 80. Because the cold finger 104 enters the array through the space between the brackets 52 and 54, the cutaways 76 and 78 which allow for side entry of the cold finger are not required. Thus the arrays configuration of FIGS. 3 and 10, utilizing L-shaped brackets, offer the advantage of using common baffles 56 and 80 in both side entry and concentric cryopumps.

Figure 11:
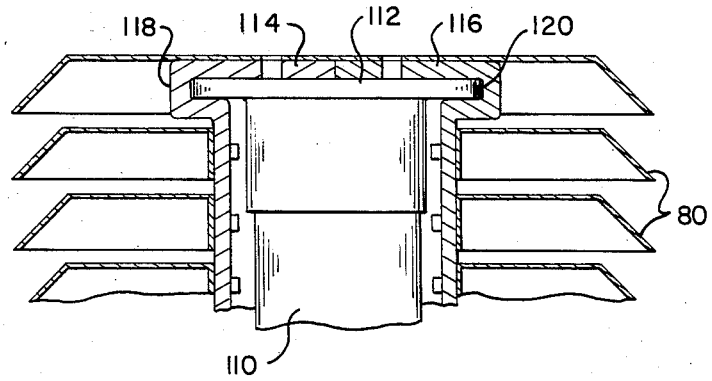
FIG. 11 is a partial sectional view similar to FIG. 10 illustrating a similar second stage array mounted to a larger diameter cold finger.

FIG. 11 illustrates how the same baffles 80 can be used even where the cold finger 110 and heat station 112 are somewhat larger than the cold finger 104 and heat station 106 of FIG. 10. In this embodiment, the brackets 114 and 116 are provided with U-shaped bends 118 which fit around the rim 120 of the larger heat station. It can be noted, however, that the spacing of the brackets 114 and 116 along the length of the cold finger 110 is identical to the spacing of the brackets 52 and 54 along the length of the cold finger 104. Therefore, common baffles 80 can used in the two arrays.

It can thus be seen that a second stage array having a relatively complex configuration has been provided which can be readily adapted to both concentric and side entry cryopumps. The split array provides excellent thermal conductance from the baffles to the second stage heat station and allows for ease of assembly, low weight, low cost and common parts.

While the invention has been particularly shown and described with reference to preferred embodiments thereof, it will be understood by those skilled in the art that various changes in form and details may be made therein without departing from the spirit and scope of the invention as defined by the appended claims.

I claim:

1. A cryopump comprising a refrigerator having first and second stages, a second stage cryopanel in thermal contact with a heat sink on the second stage to condense low condensing temperature gases, a first stage cryopanel in thermal contact with a heat sink on the first stage and held at a temperature higher than the second stage to condense higher condensing temperature gases and a radiation shield surrounding the second stage cryopanel, the second stage cryopanel comprising:

axially extending, thermally conducting brackets independently mounted to and in close thermal contact with the second stage heat sink; and fixed to each bracket, a respective array of baffle sections spaced along the bracket, each array of baffle sections forming an independently mounted array section and the array sections together forming a full second stage cryopanel.

2. A cryopump as claimed in claim 1 wherein the first and second stages extend through a side of the radiation shield generally parallel to the first stage cryopanel.

3. A cryopump as claimed in claim 2 wherein the brackets extend generally transverse to the axis of the second stage of the refrigerator and edges of baffles of the array sections closely face each other adjacent to the second stage of the refrigerator on a side of the second stage of the refrigerator opposite to the first stage cryopanel.

4. A cryopump as claimed in claim 3 wherein the baffles are semi-circular discs with frustoconical rims.

5. A cryopump as claimed in claim 4 wherein the brackets are substantially flat, L-shaped bars.

6. A cryopump as claimed in claim 1 wherein semi-circular baffles are fixed to each of a pair of brackets.

7. A cryopump as claimed in claim 1 wherein the brackets are substantially flat, L-shaped bars.

8. A cryopump comprising a refrigerator having first and second stages, a second stage cryopanel in thermal contact with a heat sink on the second stage to condense low condensing temperature gases, a first stage cryopanel in thermal contact with a heat sink on the first stage and held at a temperature higher than the second stage to condense higher condensing temperature gases and a radiation shield surrounding the second stage cryopanel and having an opening closed by the first stage cryopanel, the refrigerator extending through a side of the radiation shield generally parallel to the first stage cryopanel, the second stage cryopanel comprising:

axially extending, thermally conducting brackets independently mounted to an in close thermal contact with the second stage heat sink; and fixed to each bracket, a respective array of baffle sections spaced along the bracket, each array of baffle sections forming an independently mounted array section and the array sections together forming a full second stage cryopanel.

9. A cryopump as claimed in claim 8 wherein the brackets extend generally transverse to the axis of the second stage of the refrigerator and edges of baffles of the array sections closely face each other adjacent to the second stage of the refrigerator on a side of the second stage of the refrigerator opposite to the first stage cryopanel.

10. A cryopump as claimed in claim 9 wherein the baffles are semi-circular discs with frustoconical rims.

11. A cryopump as claimed in claim 10 wherein the brackets are substantially flat, L-shaped bars.

12. A cryopump as claimed in claim 8 wherein semi-circular baffles are fixed to each of a pair of brackets.

13. A cryopump as claimed in claim 8 wherein the brackets are substantially flat, L-shaped bars.

14. A cryopump comprising a refrigerator having first and second stages, a second stage cryopanel in thermal contact with a heat sink on the second stage to condense low condensing temperature gases, a first stage cryopanel in thermal contact with a heat sink on the first stage and held at a temperature higher than the second stage to condense higher condensing temperature gases and a radiation shield surrounding the second stage cryopanel, the second stage cryopanel comprising:

a pair of axially extending thermally conducting brackets independently mounted to and in close thermal contact with the second stage heat sink and extending in a direction generally parallel to the axis of the radiation shield; and fixed to each bracket, a respective array of semi-circular baffle sections spaced along the bracket, each array of baffle sections forming an independently mounted array section, the flat edges of the semi-circular baffles of the two array sections closely facing each other to each side of the brackets to form together a generally cylindrical array.

15. A cryopump as claimed in claim 14 wherein the brackets extend generally transverse to the axis of the second stage of the refrigerator and edges of baffles of the array sections closely face each other adjacent to the second stage of the refrigerator on a side of the second stage of the refrigerator opposite to the first stage cryopanel.

16. A cryopump as claimed in claim 15 wherein the baffles are semi-circular discs with frustoconical rims.

* * * * *